US006271634B1

(12) United States Patent
Saiger

(10) Patent No.: US 6,271,634 B1
(45) Date of Patent: Aug. 7, 2001

(54) STROBE LIGHTING CONTROL SYSTEM

(75) Inventor: George P. Saiger, Bensenville, IL (US)

(73) Assignee: Diversitronics, Inc., Elmhurst, IL (US)

( * ) Notice: Subject to any disclaimer, the term of this patent is extended or adjusted under 35 U.S.C. 154(b) by 0 days.

(21) Appl. No.: 09/515,349

(22) Filed: Feb. 29, 2000

(51) Int. Cl.[7] ..... H05B 37/00
(52) U.S. Cl. ..... 315/241 S; 315/291
(58) Field of Search ..... 315/241 S, 241 P, 315/246, 248, 291, 307, 308

(56) References Cited

U.S. PATENT DOCUMENTS 4,717,861 * 1/1988 Yuasa et al. ..... 315/241 P
5,078,039 1/1992 Tulk et al. ..... 362/85
5,315,700 * 5/1994 Johnston et al. ..... 395/163

* cited by examiner

*Primary Examiner*—Don Wong
*Assistant Examiner*—Thuy Vinh Tran
(74) *Attorney, Agent, or Firm*—Greer, Burns & Crain, Ltd

(57) ABSTRACT

A system for controlling a strobe light or the like with serial data has a first processor for decoding or recognizing commands, and a second processor for executing the commands. The serial data is typically in a standard format such as DMX-512. Also, firing of the strobe lights is controlled digitally, for precise control over both timing and intensity.

10 Claims, 7 Drawing Sheets

| DESIG | DESCRIPTION | MIN | TYP | MAX | UNIT |
|---|---|---|---|---|---|
| 21 | "SPACE" FOR BREAK | 88 | 88 | | uSEC |
| 22 | "MARK" BETWEEN BREAK & START CODE | 3.92 | 4.0 | 4.08 | uSEC |
| 23 | FRAME TIME | 43.12 | 44.0 | 44.48 | uSEC |
| 24 | START BIT | 3.92 | 4.0 | 4.08 | uSEC |
| 25 | LEAST SIGNIFICANT DATA BIT | 3.92 | 4.0 | 4.08 | uSEC |
| 26 | MOST SIGNIFICANT DATA BIT | 3.92 | 4.0 | 4.08 | uSEC |
| 27 | STOP BIT | 3.92 | 4.0 | 4.08 | uSEC |
| 28 | TIME BETWEEN FRAMES | 0 | 0 | 1.00 | SEC |

STROBE LIGHTING CONTROL SYSTEM

This invention relates to strobe lighting control systems, and more particularly to serial data control systems which separate the command recognition function from the command executing function.

BACKGROUND OF THE INVENTION

Electronic strobe lights are popular in the theatrical lighting and special effects market. In many applications, multiple strobe lights are located in various places in a facility, and they are all controlled from a central location. Typically, both frequency and speed of flashing can be adjusted as desired from the control location.

Strobe lights and other theatrical devices are often controlled using a serial transmission format adopted by the USITT, known as DMX-512. This standard is widely used to control lighting and other products such as color changers and fog machines in the theatrical field. Using serial data transmission, a plurality of devices can be controlled by a single line.

Each strobe light in a system using the DMX-512 format recognizes commands directed to it, and decodes and executes the commands. One control system for such strobe lights is disclosed in Tulk et al. U.S. Pat. No. 5,078,039. However, this system uses one microprocessor to perform both the command recognition function and the command execution function. The system also has some limitations in terms of cost, complexity and features. Moreover, strobe intensity is controlled by a ramp generator, which of course is an analog signal. While analog control is generally acceptable, its precision is limited.

Thus, there is a need for control systems for strobe lights and other theatrical devices which are controlled through serial data links and are simpler and less expensive than known devices. There is also a need for strobe lights and control systems for strobe lights which more precisely control intensity, and have more features than existing devices.

OBJECTS OF THE INVENTION

Accordingly, one object of this invention is to provide new strobe light control systems.

Another object is to provide new serial data control systems which are simpler and less expensive than known devices.

Still another object is to provide new serial data control systems which separate the command recognition and command execution functions.

Yet another object is to provide new strobe control systems which control strobe intensity with greater precision.

SUMMARY OF THE INVENTION

A system for controlling strobe lights and the like with serial data has a first processor for recognizing or decoding commands, and a second processor for executing the decoded commands. The first processor continually monitors the system for additional commands, and interrupts the second processor when a command is received. Also, firing of the strobe lights is controlled digitally, for precise control over both timing and intensity.

BRIEF DESCRIPTION OF THE DRAWINGS

The above mentioned and other features of this invention and the manner of obtaining them will become more apparent, and the invention itself will be best understood by reference to the following description of an embodiment of the invention taken in conjunction with the accompanying drawings, in which:

FIG. 2(*b*) is a specification summary for the timing chart of FIG. 2(*a*);

DETAILED DESCRIPTION

Figure 1:
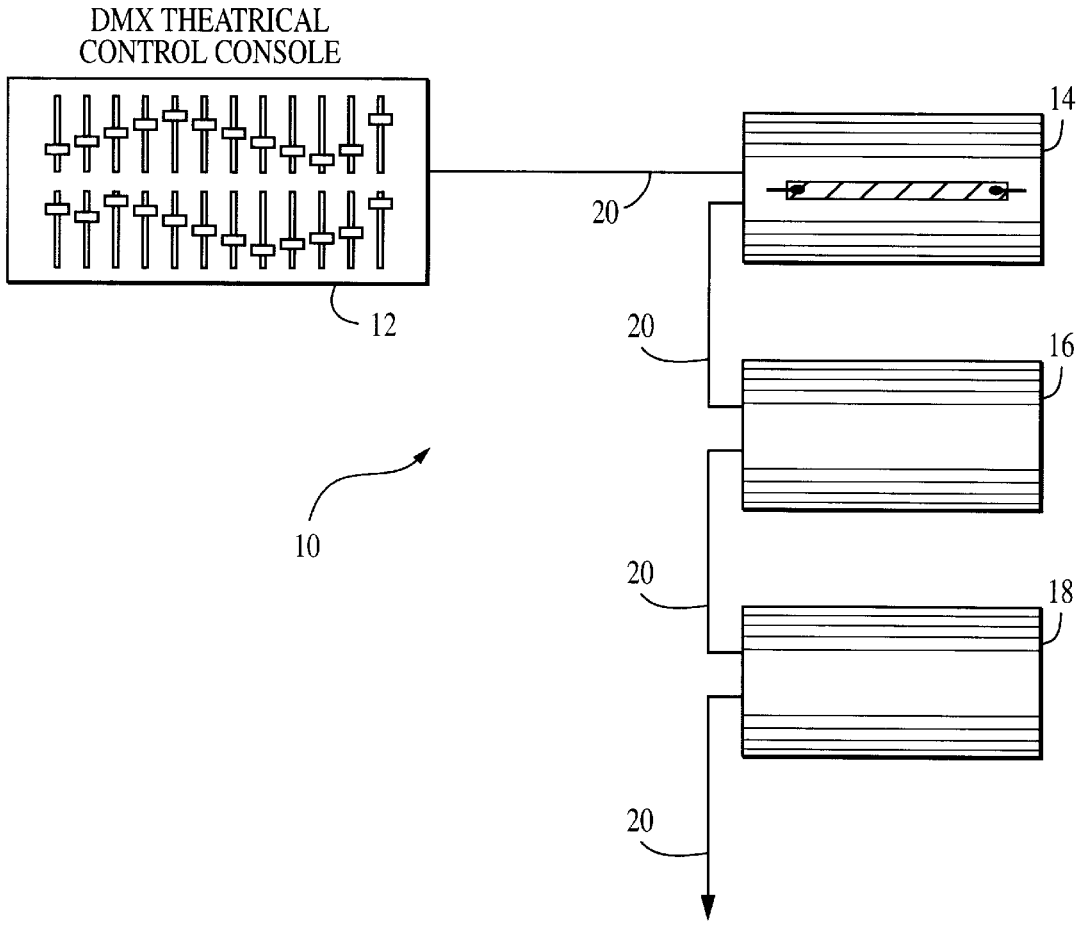
FIG. 1 is a block diagram of a lighting and special effects system.

As seen in FIG. 1, a typical theatrical or entertainment lighting and/or special effects system 10 includes a central control unit 12 and a plurality of lighting and/or special effects devices 14, 16, 18, including one or more strobe lights 14. Devices 14, 16, 18 are connected to the central control unit 12 through a serial line 20.

Figures 2A, 2B:
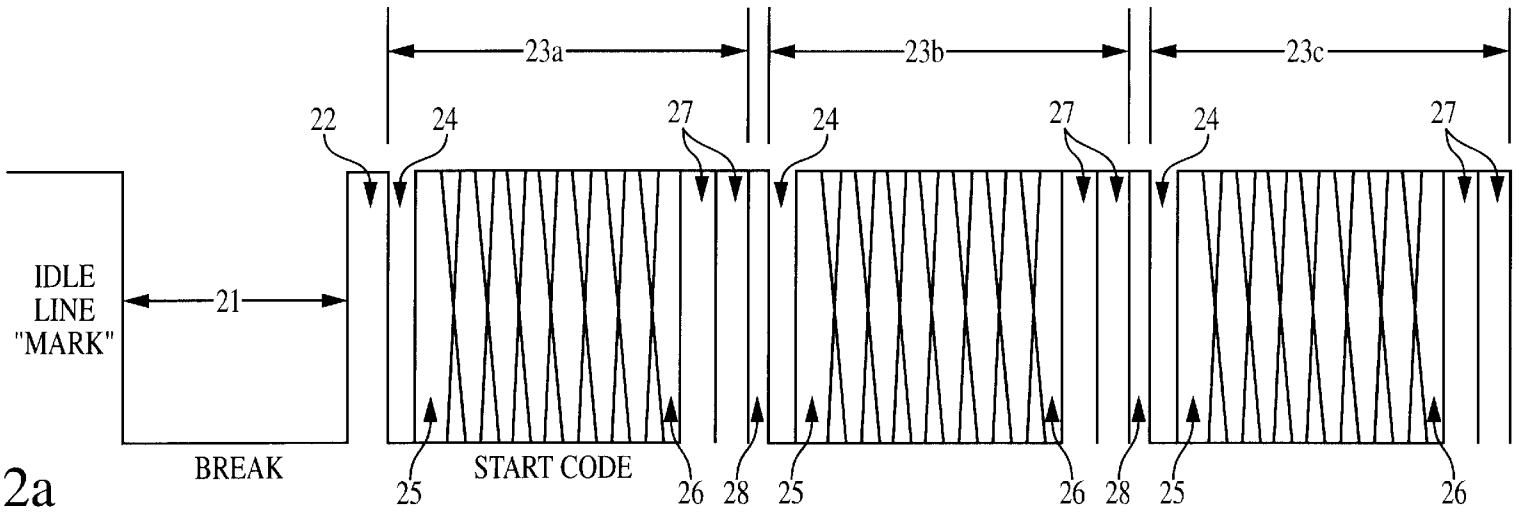
FIG. 2(*a*) is a timing chart used to control the system of FIG. 1.

Serial data commands can be sent in the DMX-512 format, shown in FIGS. 2(*a*) and 2(*b*). The serial data is sent in a continuous series of packets. According to the standard, the maximum time between packets is one second, although a typical time is about 23 milliseconds.

Each packet is preceded by a break 21 which lasts for 88 microseconds. A 4 microsecond mark 22 follows the break 21, followed by a first frame 23*a* and a plurality of subsequent frames 23*b*, 23*c*.

The first frame 23*a* includes a start bit 24 and several data bits 25, typically 8, starting with a least significant bit 25 and ending with a most significant bit 26, followed by one or more stop bits 27. There is some allowance for a time 28 between frames.

A typical frame time is 44 microseconds. The first frame 23*a* is a start code, and successive frames 23*b*, 23*c*, etc., are directed to the respective devices 14, 16, 18, in any desired order. Each command to a particular device can include one or more frames.

Figure 3:
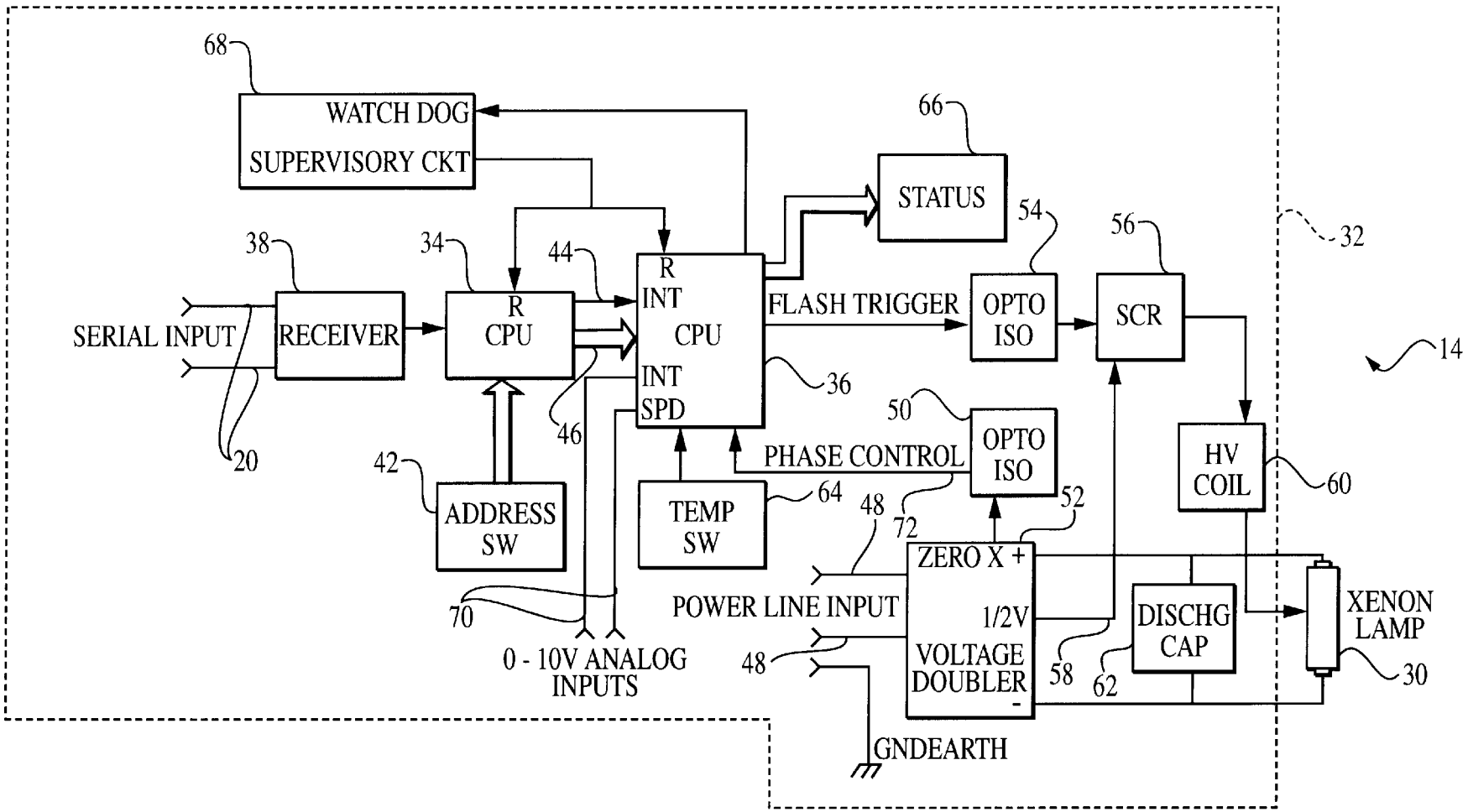
FIG. 3 is a block diagram of a control system for a strobe light used in the system of FIG. 1.

Referring now to FIG. 3, the strobe light 14 includes a xenon lamp 30 and a control circuit 32. The control circuit 32 includes a first processor CPU 34 and a second processor CPU 36. The CPU 34 receives commands from a receiver 38, which is responsive to data received from the control center 12 on lines 20. While the data is typically in DMX-512 serial format, other formats could be used.

The CPU 34 counts the frames in each serial data packet from each break to a frame number determined by an address switch 42. The command in the selected frame or frames is sent to the processor 36 for execution by interrupting the processor 36 on line 44 and sending the decoded command on a bus 46. The commands typically tell to the strobe light to turn on or off, and can dictate both the intensity of the light and the strobe speed. The commands are executed using software which is preferably embedded in the CPU 36.

Figure 4:
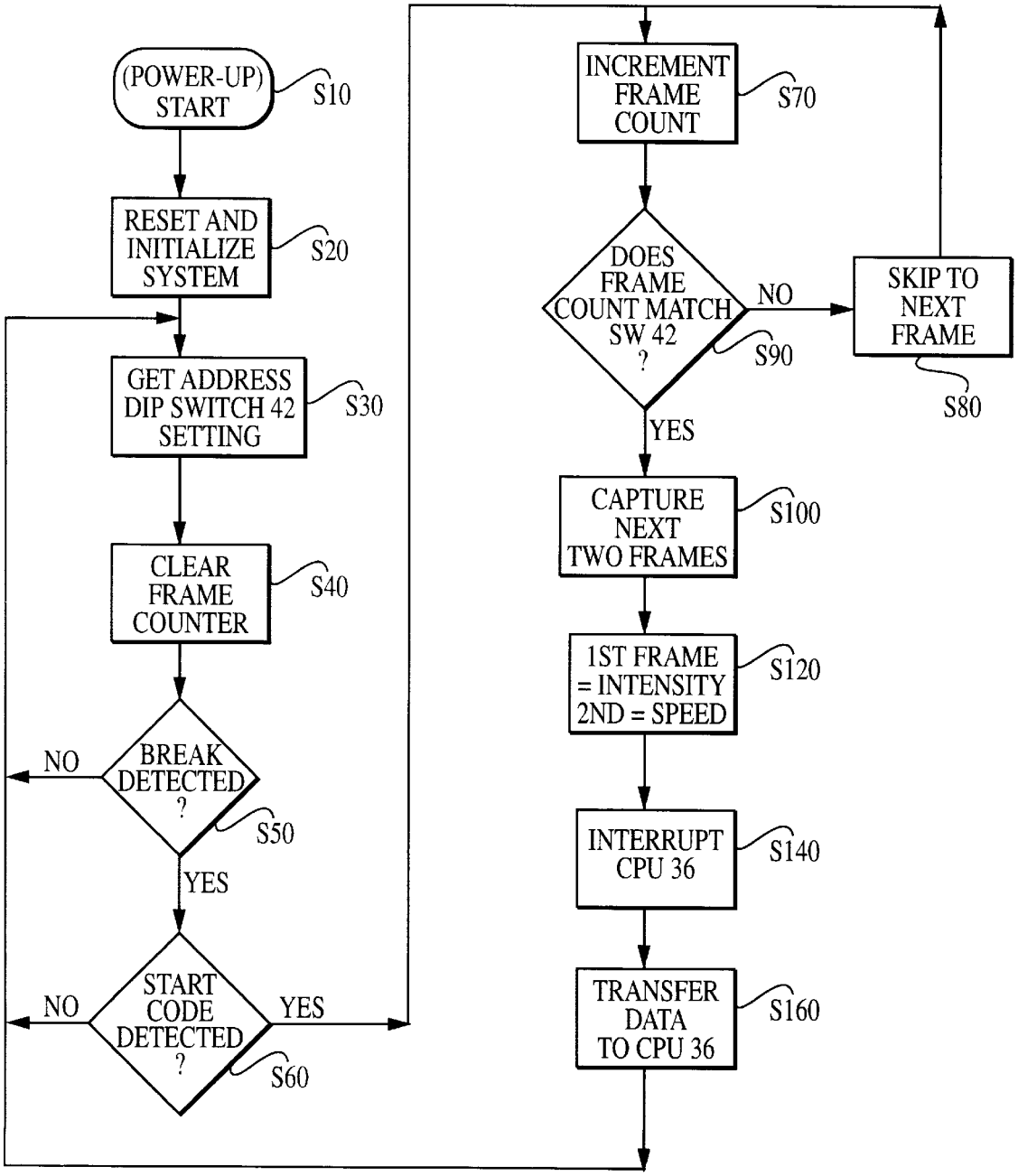
FIG. 4 is a flow chart of the command recognition process in the system of FIG. 3.

The software for the processor 34 is shown in greater detail in FIG. 4. When power is turned on and the processor 34 is started at step S10, the system is reset and initialized (S20). The CPU 34 retrieves the switch setting of the address switch 42 (S30) and clears an internal frame counter (S40). Steps S30 and S40 are repeated until a break is detected (S50), indicating that one data packet is completed and another is about to be sent. When a break is detected and a start code is found (S60), then the processor begins to increment its frame count (S70) as successive frames are detected and counted. The frame count is incremented until it matches the number in the switch 42 (S90). When a match is found, the next frame or more typically two frames are captured (S100).

The first captured frame can be recognized as including intensity information and the second frame can be recognized as including speed information (S120), for example. When a command is recognized, the processor 34 interrupts the processor 36 (S140) and the command is transferred to the processor 36 (S160). The processor 34 then returns to step S30 and the process is repeated.

In this manner, the processor 34 identifies its unique command or commands in every packet. Typically, one command is continually sent in successive packets at a suitable packet refresh rate, until a different command is sent. Thus, once a particular command is received, the processor 36 continues to execute that command until a different command is received.

Figure 6:
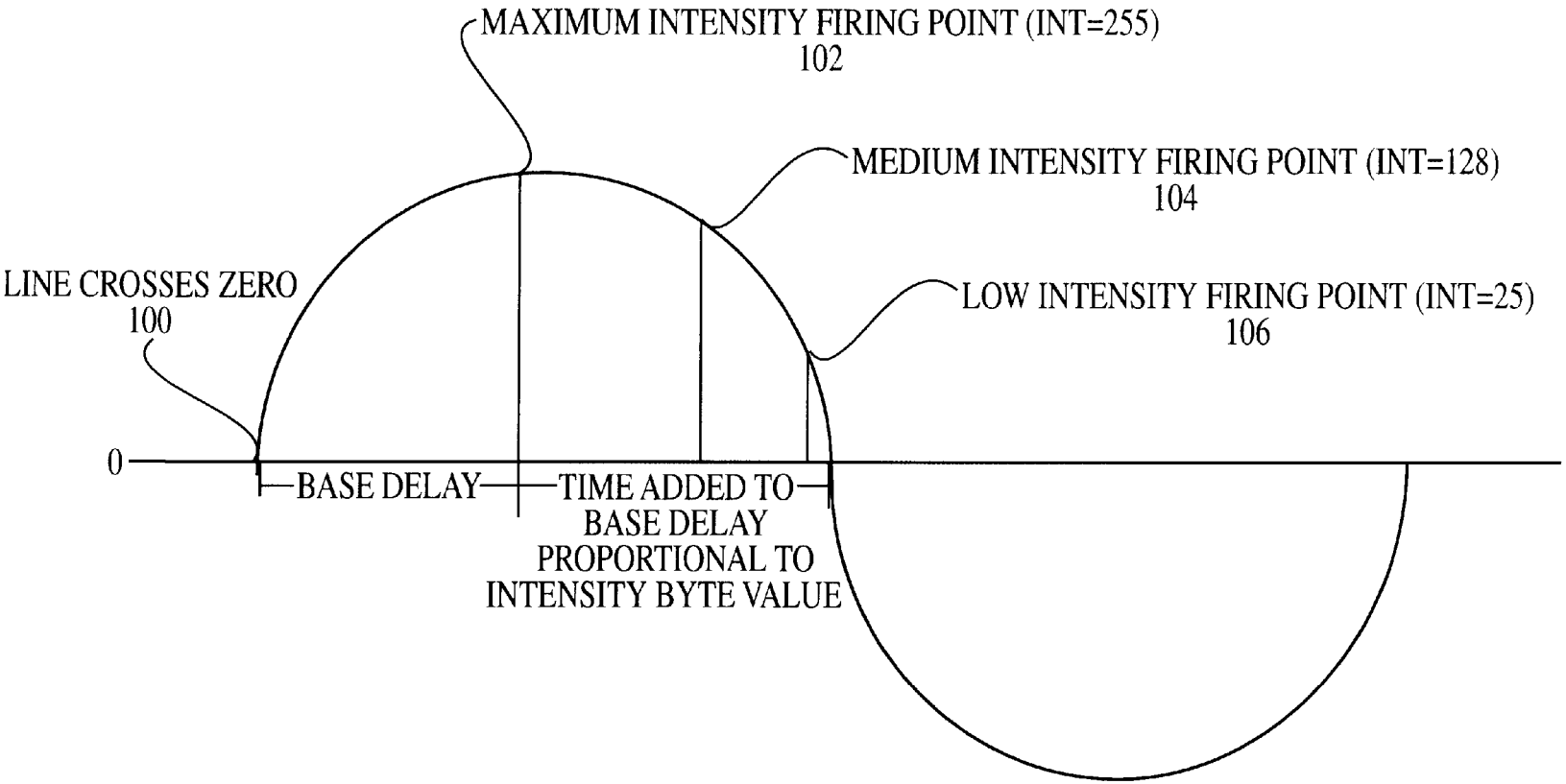
FIG. 6 is a diagram which illustrates digital control of strobe firing.

Returning now to FIG. 3, the CPU 36 generates a flash trigger signal based on the intensity and speed commands. Using a power line input provided at 48, the processor 36 monitors the zero crossing of the line voltage signal through an optical isolator 50 and a voltage doubler 52, and calculates a phase control signal, which will be described later with reference to FIG. 6.

The processor 36 produces a flash trigger signal at the appropriate time, which passes through an optical isolator 54 to trigger an SCR 56. A voltage from the voltage doubler 52 is also provided to the SCR 56 on a line 58, which drives a high voltage coil 60 when the SCR 56 is triggered. The high voltage coil 60 lights the lamp 30 in conjunction with a discharge capacitor 62.

Other features of the control circuit 32 include a temperature switch 64 which disables the processor 36 if the temperature in the device becomes excessive, and one or more status lights 66 (such as LED's) which can indicate whether DMX commands are present, whether the high temperature switch is closed, whether the strobe light is flashing, etc. A supervisory circuit 68 can be provided to reset the processors 34, 36 when power fails, or if a watchdog signal is not detected from the processor 36 within a predetermined time period. Finally, zero to ten volt analog inputs can be provided on lines 70, for independently setting the intensity and speed of the strobe light flashes, if desired.

Figures 5, 5A:
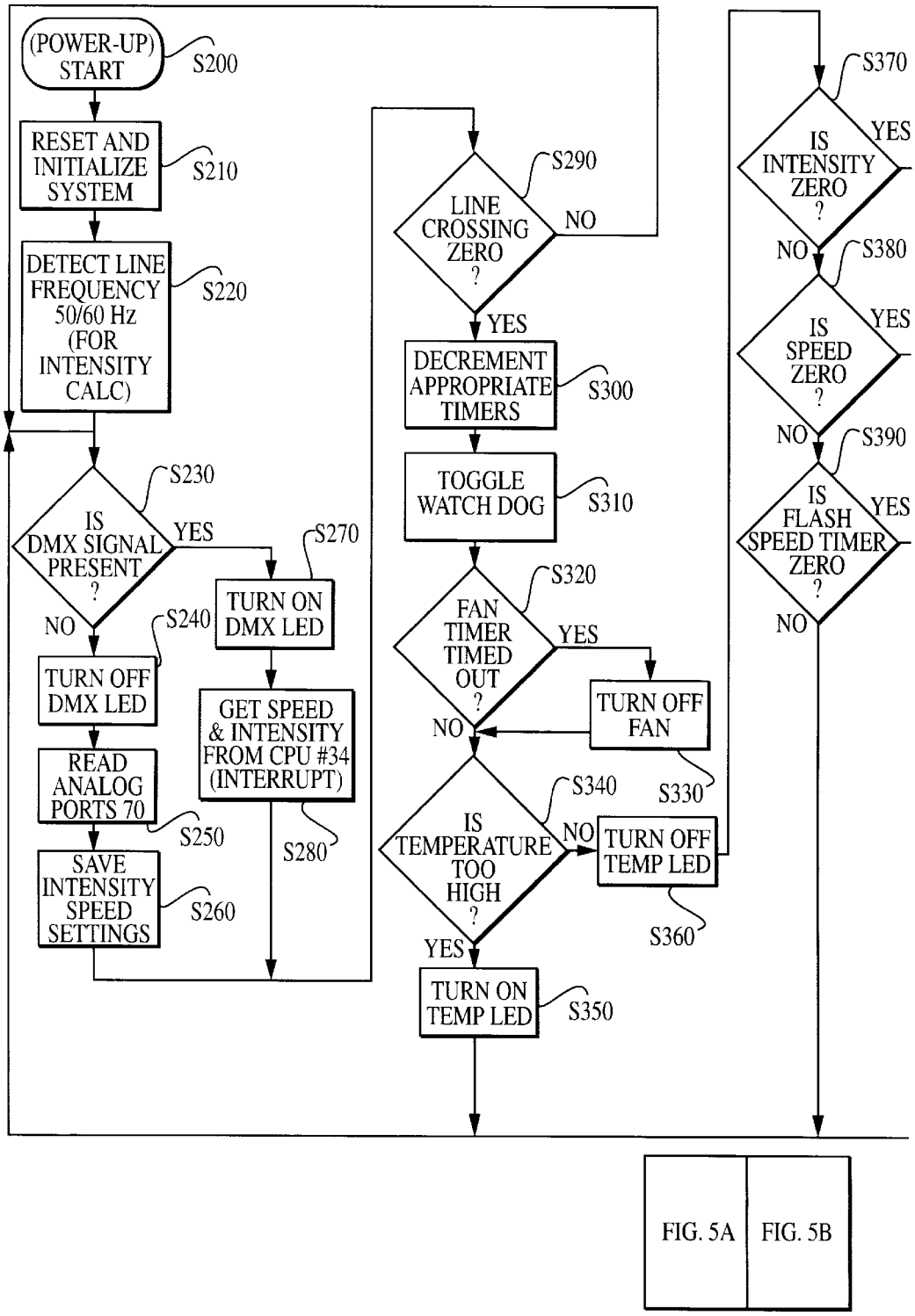
FIGS. 5A and 5B are a flow chart of the command execution process in the system of FIG. 3.
Figure 5B:
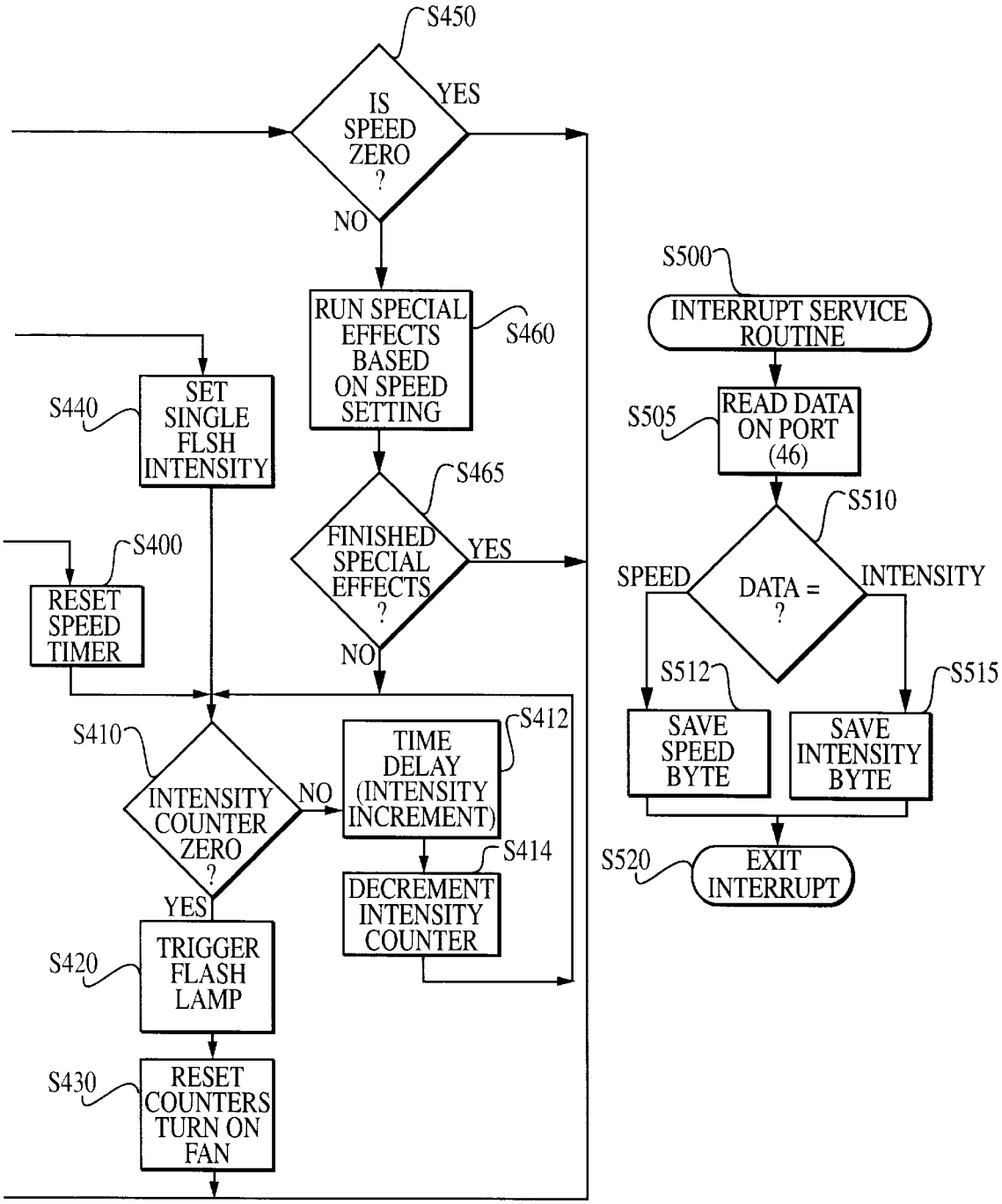

The processor 36 may be programmed in the manner shown in FIGS. 5A and 5B. After power up (S200), the system is reset and initialized at S210. The line frequency is measured at S220, to determine whether the line voltage operates at 50 Hz or 60 Hz.

If a DMX signal is not present (S230), a DMX LED in the status lights 66 is turned off (S240) and the processor reads analog ports 70 in FIG. 3 (S250). If present at the ports 70, the intensity and speed settings are saved at S260.

If a DMX signal is present (S230), the DMX LED is turned on (S270) and the DMX speed and intensity settings transferred from the processor 34 are recognized (S280).

When the processor 36 identifies the intensity and speed settings at step S260 or step S280, the processor 36 determines whether the line voltage is at a zero crossing point through a line 72 in FIG. 3 (S290). If not, the system recycles to step S230 and repeats the processes described previously until a zero crossing is detected in step S290. The timers typically include a fan timer and a speed of flash timer. When a zero crossing is detected, appropriate timers are decremented (S300). The supervisory or watchdog circuit 68 is toggled or reset (S310), so that the supervisory circuit 68 does not mistakenly reset the system. If an internal fan timer has timed out (S320), the fan (not shown) is turned off (S330). If it has not timed out, or after the fan is turned off, the processor 36 determines whether the temperature is above a predetermined limit (S340). If so, a Temperature LED in the lights 66 is turned on (S350), and the system returns to step S230. If the temperature is not too high, the Temperature LED in lights 66 is turned off (S360) and the processor 36 determines whether the intensity is set to zero (S370). If not, the processor 36 determines whether the speed is set to zero (S380). If not, the processor then determines whether the flash speed is set to zero (S390), and if not, the system returns to step S230.

If the flash speed timer is zero (S390), an internal speed timer is reset (S400), an intensity counter is checked (S410), and if it is zero, the delay needed to obtain a desired intensity is calculated (S410), and the lamp 30 is triggered to flash (S420). Then, the fan timer is reset and the fan is turned on (S430).

Returning now to step S380, if the speed is zero, the single flash intensity is set (S440) and the processor 36 proceeds to steps S410 et seq.

Returning again to step S370, if the intensity is zero, and the speed is not zero (S450), then a special effect which includes several flashes based on the speed setting is run (S460). Special effect features can include lightning simulation, continuous light, cross fade, fade down, single emission and the like. If the special effect is finished (S465), the routine returns to S230. If not, the routine goes to S410. The processor then performs steps S410, S420, S430 before returning to step S230. If the speed is zero at step S450, the processor returns to S230.

Flash intensity is determined digitally in a subroutine which starts at S410. Intensity is controlled by turning the strobe light on for a desired portion of each 60 Hz sine wave during firing, measured from a zero crossing point of each cycle, such as the cycle shown in FIG. 6. When zero crossing point 100 is detected (S290), a digital timer calculates a base time delay which typically corresponds to a 90° phase change of the voltage at a point 102 and an additional delay which is a function of the desired intensity set at S260 or S280 (S412). The intensity counter is decremented from its set value to zero (S414), and the lamp is triggered (S420). If maximum intensity is desired, the strobe light is triggered at the point 102. If less intensity is desired, the delay is increased by adding digital increments to the base delay reached at 102. For example, medium intensity can be obtained by delaying firing to a point 104, which is about 145° from the zero crossing point 100, and low intensity can be found by delaying filing to a point 106, which is about 170° from the point 100. In this manner, the intensity can be accurately controlled.

The processor 34 interrupts the processor 36 about every 23 milliseconds. When an interrupt is received, the processor 36 immediately stops its normal program and runs through an interrupt service routine at S500 in FIG. 5. Data on port 46 is read (S505) and recognized (S510). Speed data (S512) and intensity data (S515) are saved and the interrupt routine is finished (S520). The processor 36 then returns to the place in the program where the processors was when the interrupt was received. The interrupt routine typically takes about 20 μsec., so it is not noticeable to the user.

While the principles of the invention have been described above in connection with specific apparatus and applications, it is to be understood that this description is made only by way of example and not as a limitation on the scope of the invention.

What is claimed is:

1. A control system for a strobe light that operates on alternating current, the control system comprising a first processor for recognizing commands and a second processor for executing commands which have been decoded by said first processor, the control system further having a detector for detecting zero voltage crossing points in cycles of the alternating current, said second processor using a selected said zero crossing point to control the intensity of the light emitted from the strobe light by delaying firing of the strobe light in each cycle at least through a base delay that determines the maximum intensity of the light, until the cycle reaches a predetermined point from the base delay of the cycle, the predetermined point being identified by decrementing at least one digital counter.

2. The control system of claim 1 wherein said first processor interrupts said second processor when a command is recognized by said first processor.

3. The control system of claim 1 wherein said commands include both speed and intensity information.

4. The control system of claim 1 wherein the commands are in serial data, the serial data including commands for a plurality of devices, including the strobe light.

5. The control system of claim 4 wherein said serial data is sent in packets.

6. A strobe light that operates on alternating current comprising:

a strobe lamp capable of emitting light at a predetermined speed and intensity;

a power source for said strobe lamp;

a first processor for receiving and recognizing commands for the strobe light;

a second processor for executing commands which have been decoded by said first processor, said second processor controlling the power source to the strobe lamp in accordance with the commands; and a detector for detecting zero voltage crossing points in cycles of the alternating current, said second processor using selected said zero crossing points to control the intensity of the light emitted from the strobe lamp by delaying firing of the strobe lamp in each cycle at least through a base delay that determines the maximum intensity of the light, until the cycle reaches a predetermined point from the base delay of the cycle, the predetermined point being identified by decrementing at least one digital counter.

7. The strobe light of claim 6 wherein said first processor interrupts said second processor when a command is recognized by said first processor.

8. The strobe light of claim 6 wherein said commands include both speed and intensity information.

9. The strobe light of claim 6 wherein the commands are in serial data, the serial data including commands for a plurality of devices, including the strobe light.

10. The strobe light of the claim 9 wherein said serial data is sent in packets.

* * * * *